US010934722B2

(12) United States Patent
Cipriani

(10) Patent No.: US 10,934,722 B2
(45) Date of Patent: Mar. 2, 2021

(54) SUPPORT SYSTEM FOR RAISED FLOORING AND FLOORING OBTAINED BY THIS SUPPORT SYSTEM

(71) Applicant: Dakota Group S.a.s. di Zeno Cipriani & C., Affi (IT)

(72) Inventor: Zeno Cipriani, Affi (IT)

(73) Assignee: DAKOTA GROUP S.A.S. DI ZENO CIPRIANI & C., Affi (IT)

( * ) Notice: Subject to any disclaimer, the term of this patent is extended or adjusted under 35 U.S.C. 154(b) by 0 days.

(21) Appl. No.: 15/495,146

(22) Filed: Apr. 24, 2017

(65) Prior Publication Data

US 2018/0112417 A1 Apr. 26, 2018

(30) Foreign Application Priority Data

Oct. 25, 2016 (IT) ..... 102016000107627

(51) Int. Cl.
*E04F 15/024* (2006.01)
*E04F 15/04* (2006.01)
*E04F 15/02* (2006.01)

(52) U.S. Cl.
CPC .. *E04F 15/02494* (2013.01); *E04F 15/02194* (2013.01); *E04F 15/02405* (2013.01); *E04F 15/02452* (2013.01); *E04F 15/043* (2013.01); *E04F 2015/02116* (2013.01)

(58) Field of Classification Search
CPC ..... E04F 15/02494; E04F 15/02452; E04F 15/043; E04F 15/02194; E04F 15/02405; E04F 2015/02116
See application file for complete search history.

(56) References Cited

U.S. PATENT DOCUMENTS 4,277,923 A * 7/1981 Rebentisch ..... E04F 15/02458 52/126.6
4,508,162 A * 4/1985 Radtke ..... E04F 15/02405 165/49
6,818,275 B2 * 11/2004 Guarda ..... B32B 9/04 404/44
7,698,859 B2 * 4/2010 Sansano Marti . E04F 15/02183 52/177
9,683,375 B2 * 6/2017 Kugler ..... E04F 15/02447
(Continued)

FOREIGN PATENT DOCUMENTS

EP 0 257 237 A2 3/1988
GB 2514316 A 11/2014
(Continued)

OTHER PUBLICATIONS

European Search Report issued in Application No. 17 19 8125, dated Apr. 17, 2018.

*Primary Examiner* — Basil S Katcheves
*Assistant Examiner* — Omar F Hijaz
(74) *Attorney, Agent, or Firm* — Nixon & Vanderhye

(57) ABSTRACT

The present invention refers to a support system for raised flooring made with wooden boards and to the relative flooring obtained by this system. The supporting system is used for obtaining a floor with boards made of wood or similar material wherein the floor is elevated with respect to the reference ground. The supporting system includes a trampling plate and at least three supporting feet fixed to the plate in order to support the plate with respect to the reference ground.

8 Claims, 4 Drawing Sheets

(56) References Cited

U.S. PATENT DOCUMENTS

| | | | | |
|---|---|---|---|---|
| 2005/0034403 | A1* | 2/2005 | Chen | E04F 15/022 52/578 |
| 2006/0260223 | A1* | 11/2006 | Wang | E04F 13/0862 52/177 |
| 2010/0257801 | A1* | 10/2010 | Anderson | E01C 5/001 52/391 |
| 2011/0016809 | A1* | 1/2011 | Knight, III | E04D 11/007 52/263 |
| 2014/0096763 | A1* | 4/2014 | Barmore | F24D 3/122 126/714 |
| 2016/0040439 | A1* | 2/2016 | Pelc | E04F 15/02452 52/126.6 |
| 2016/0244979 | A1* | 8/2016 | Greaves | E04F 15/02452 |

FOREIGN PATENT DOCUMENTS

| | | | | |
|---|---|---|---|---|
| JP | 2003301589 | A * | 10/2003 | E04F 15/022 |
| KR | 101 481 524 | B1 | 1/2015 | |
| WO | 2006/090967 | A1 | 8/2006 | |
| WO | 2008/051723 | A2 | 5/2008 | |
| WO | 2013/190400 | A1 | 12/2013 | |
| WO | 2016/181328 | A1 | 11/2016 | |

* cited by examiner

SUPPORT SYSTEM FOR RAISED FLOORING AND FLOORING OBTAINED BY THIS SUPPORT SYSTEM

The present invention refers, in general, to a support system for raised flooring and to the relative flooring obtained by this system. More particularly, the present invention refers to a support system for flooring made with wooden boards or boards made of other materials and a flooring comprising said system including wooden boards or boards made of another material.

The raised flooring is a suspended flooring system in which the treading area rests on a raised structure, elevated from the ground which is usually formed by using suspended modular elements. Thus, it is possible to obtain a technical compartment for inspection between the bottom and the treading plane, the technical compartment being available, for example, for the passage of cables.

As is known, there exist several types of elevated flooring, including the flooring allowing the construction of a stable wooden surface, for example by utilizing wooden boards.

The procedure of realization of said raised wooden floors consists in making, at first, an elevated support base and then, fixing the wooden boards. The fixing of the wooden boards is performed by fastening each board at a time to the support base and adjacent to the last fixed board.

The procedure of realization and installation is thus rather laborious and, consequently, slow.

Besides, in the case a portion of the support should yield because of breakages of the base or breakages of possible support feet, it is necessary to remove the boards arranged superiorly to said portion, affecting thus a greater part of the flooring than the interested portion of the support, because the boards can have a greater length than that of a single suspended modular element.

An aim of the invention is, therefore, to provide a support system for elevated floors consisting of wooden boards or boards made of a similar material in order to overcome the problems of the prior art.

Another aim of the invention is to provide a support system for elevated floors obtained with wooden boards in order to make the assembly operations convenient and fast.

Another aim of the invention is to provide a support system for elevated floors obtained with wooden boards, which system, in case of breakages, is repairable easily and quickly enough.

All the aims and still others are achieved according to the invention by a support system for the realization of a flooring with wooden boards, or boards made of a similar material, said flooring being elevated with respect to a reference ground.

The support system comprises a treading plate and at least three support feet fixed to the plate so as to support the plate with respect to the reference ground.

In particular, the support system is characterized by the fact that the plate comprises at least one grid of quadrangular conformation, at least two wooden boards being fixed to the at least one grid, said wooden boards having a length equal to the length of the one or more grids and having an overall width equal to the width of the one or more grids.

Through this conformation, the wooden boards cover entirely the surface of the grid, one grid or more than one, depending on the size of the plate, and at the same time, the wooden boards do not protrude from the plate. In this way, the plate is a single modular element that can be put alongside analogous plates in order to obtain the final surface without further working.

Thus, the wooden boards do not interest more than one plate and it is possible to mount or lift a single plate without removing the wooden boards from the respective grids.

Advantageously, the support system according to the invention may provide that at least one seat is formed in the one or more grids, a strip in a rigid material, such as wood or steel, being received in said seat.

In this way, the plate is stiffened so as to avoid unwanted downturns in the flooring in correspondence of the portions that are not interested by the support feet.

Besides, the one or more seats may be formed along a side of the one or more grids that belong to the same plate so that it is possible to position strips of maximum length.

Advantageously, in order to further increase the rigidity, the grid may comprise four seats in which the respective strips may be received and said grids may be formed along each side of the grid.

In order to obtain a stable union, the wooden boards may be fixed to the grid by means of nails.

Advantageously, in order to facilitate a correct positioning of the nails, pre-formed holes may be formed in the grid for the passage of the nails.

Moreover, holes may be formed in the grid and include seats for the fixing of feet.

Likewise, also the corners of the grid may be sunken and may provide at least one seat for a stable connection with a foot.

Further features and details of the invention will be better understood from the following specification that is provided by way of a non-limiting example, as well as from the annexed drawings, wherein.

Figures 1, 2, 3:
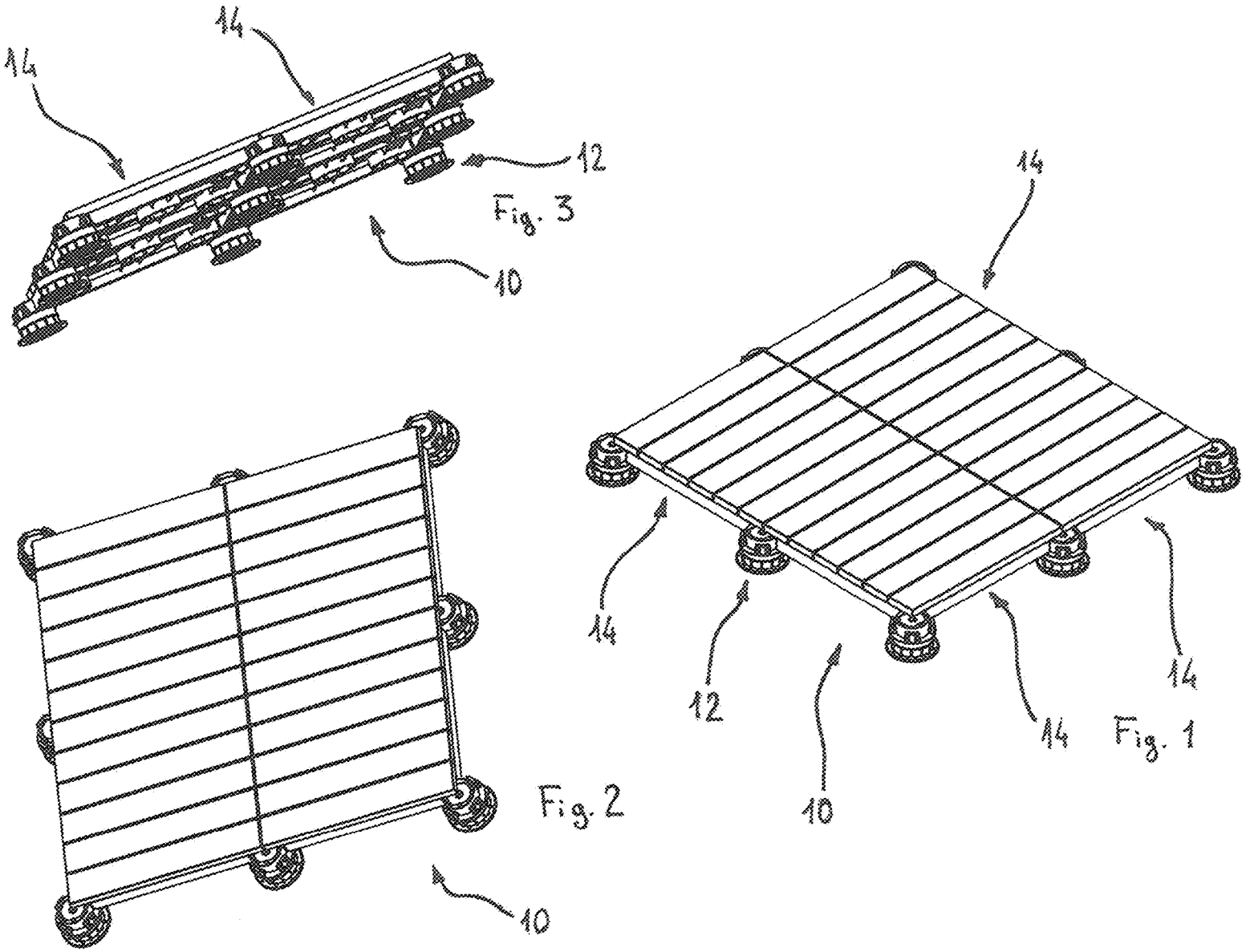
FIGS. 1, 2 and 3 are axonometric views of a flooring portion that takes advantage of a support system according to the invention formed by a set of plates resting on support feet.
Figure 4:
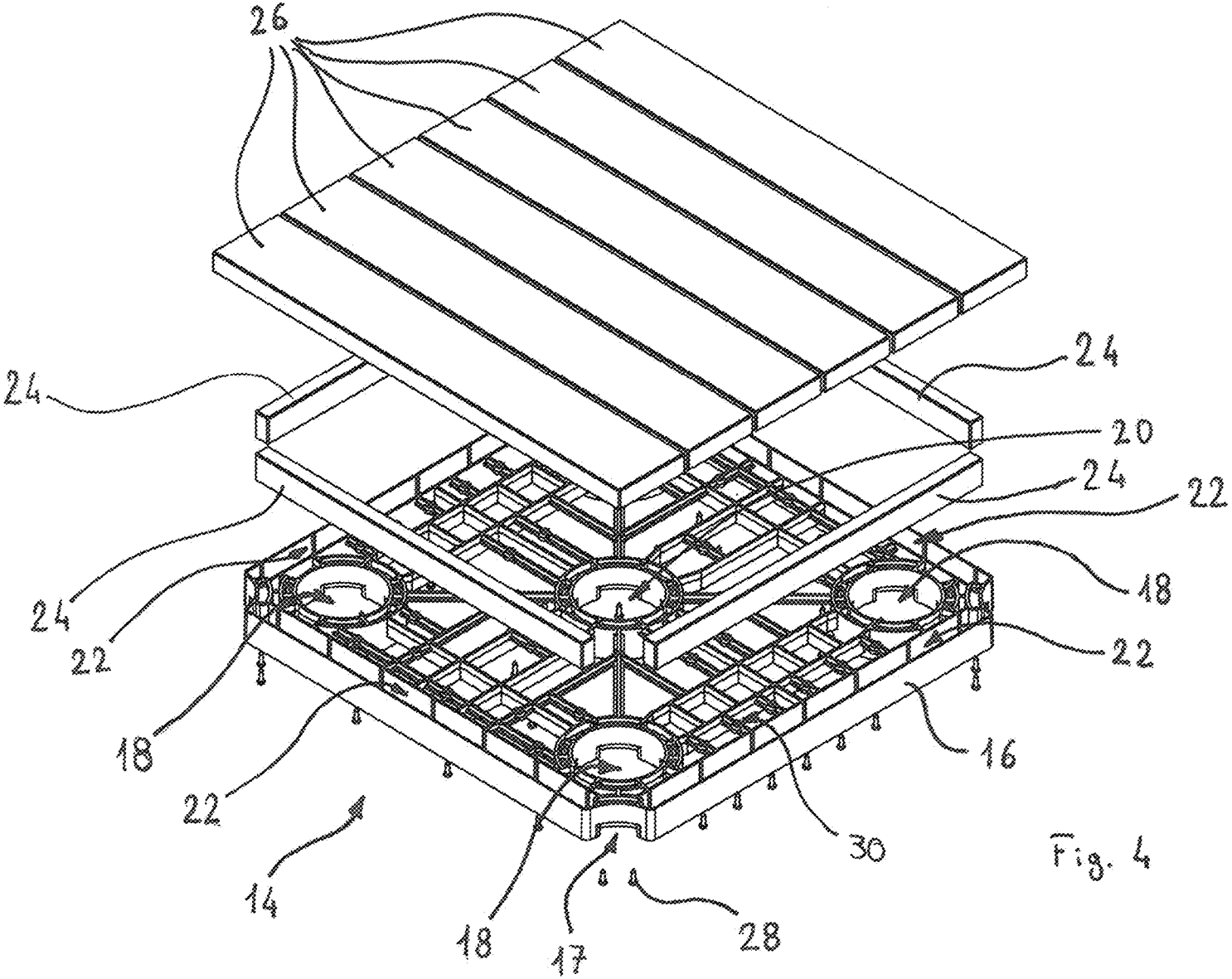
FIG. 4 is an exploded axonometric view of a plate with wooden boards, utilized to implement the support system in FIG. 1.
Figure 5:
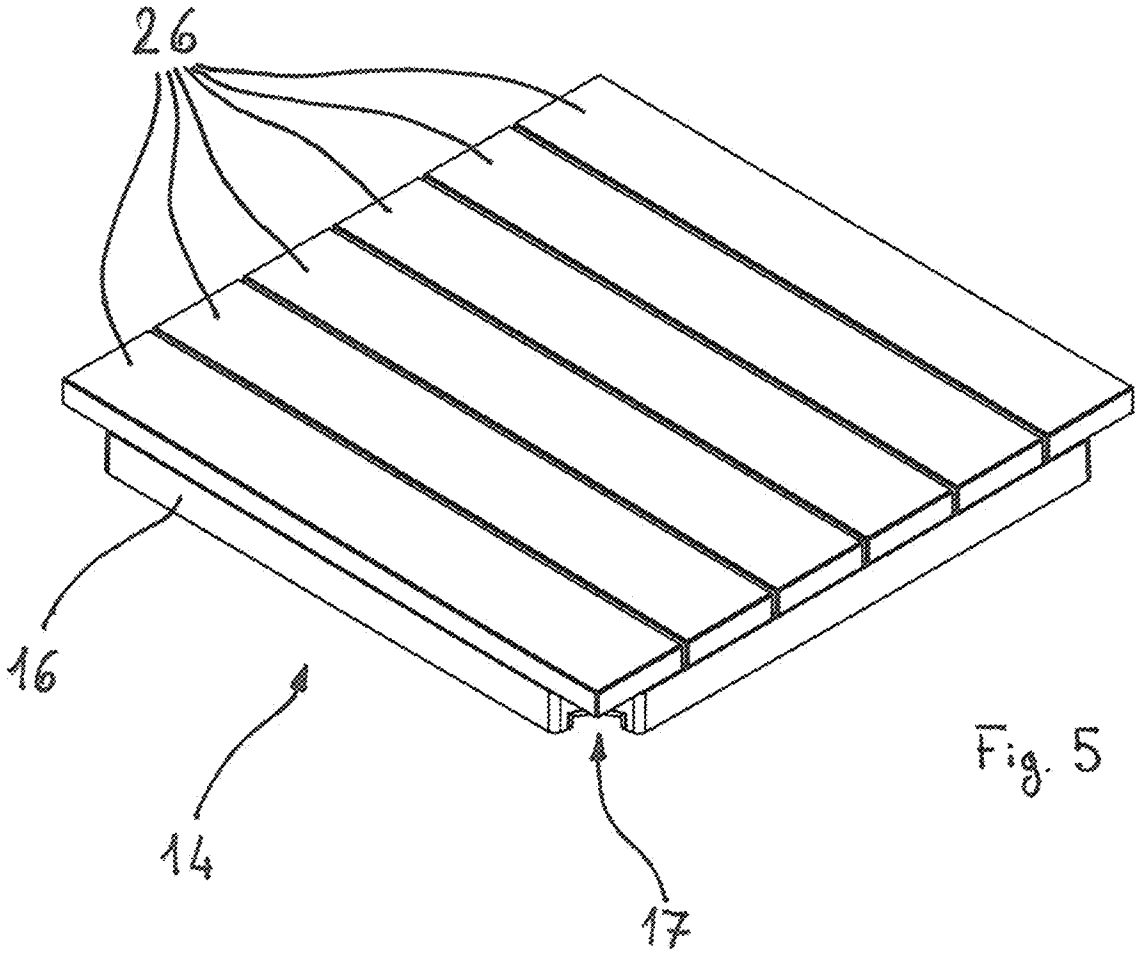
FIGS. 5 and 6 are axonometric views of the plate in FIG. 4.

With reference to the annexed drawings, in particular FIGS. 1, 2 and 3, number 10 denotes a portion of flooring that takes advantage of a support system according to the invention for raised flooring and comprises supporting feet 12 and treading plates 14, exactly four, supported by said supporting feet 12.

As shown in the FIGS. 4 to 11, each treading plate 14 comprises a grid 16 having a reticular structure and a substantially square shape with sunken corners 17, a seat being formed at each sunken corner for a stable connection with a supporting foot 12.

Besides, a central hole 20 and four holes 18 are formed in the grid 16, each hole being formed at a corner of the grid 16.

Each of the five holes 18, 20 is provided with suitable seats for the connection with a supporting foot 12.

The conformation of the supporting feet 12 and the seats formed in the grid 16, as well as the mode of connection of the feet 12 to the grid 16 are already known and described in the following patent document: patent application No. 102015902350751, to which reference may be made for a better comprehension.

Four longitudinal seats 22 are formed at the four sides of the grid 16, one seat for each side, in which strips 24 may be received, one strip for each seat 22.

The strips 24 are made of wood; the function of the strips is the strengthening of the entire grid 16 and the avoidance of unwanted bending of the upper treading plane.

Obviously, the strips 24 may be made also of steel or another rigid material.

Six wooden boards 26 are fixed on the upper surface of the grid 16 and are fixed by nails 28 to the grid.

In particular, the length of the boards 26 is equal to the length of the grid 16; likewise, also the whole width of the set of boards 26 covers the grid 16 entirely, without protruding.

In this way, the six boards 16 cover the entire surface of the grid and even the angular empty portion corresponding to the sunken corners 17. Thus, the plate 14 has an upper surface which is perfectly square.

Figure 11:
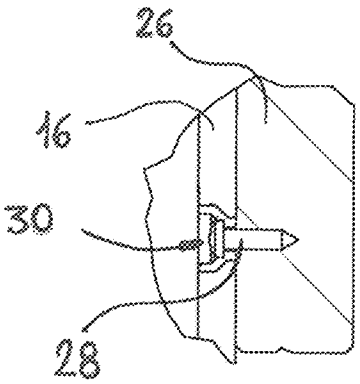
FIG. 11 is a view of a detail of the plate in FIG. 7, denoted by B in FIG. 10.
Figure 10:
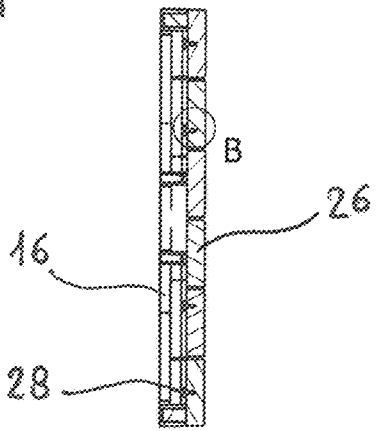
FIG. 10 is a side view of the plate in FIG. 7, sectioned according to a transverse plane denoted by A in FIG. 7.
Figure 9:
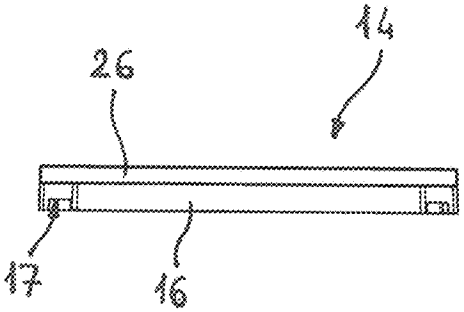
FIGS. 8 and 9 are side views of the plate in FIG. 7.
Figure 7:
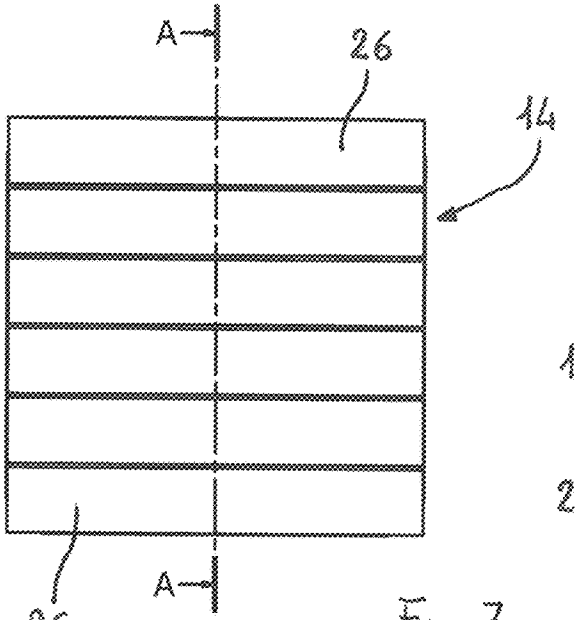
FIG. 7 is a top view of the plate in FIG. 4.
Figure 6:
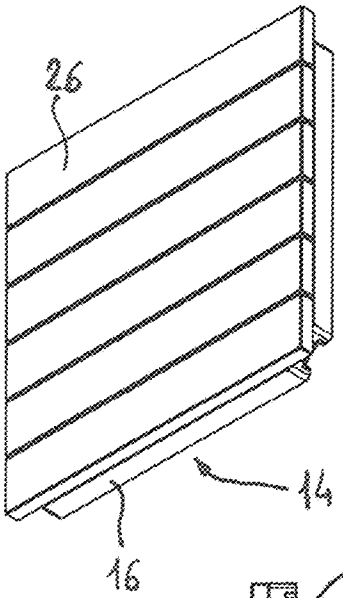
Figure 8:
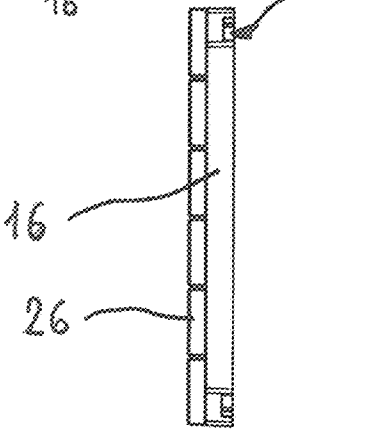

As shown, in particular in FIGS. 10 and 11, the nails are hammered upwards in the bottom of the grid 16 and have a height less than the thickness of the wooden boards 26.

In this way, the treading surface of the plates 14, namely the visible surface of the boards 26, is clean and free of bodies or elements.

Pre-formed holes 30 are formed in the grid 16 to facilitate a correct positioning of the nails 28.

The so-obtained elevated flooring 10 may be easily made through the support system according to the invention, which is a modular support system.

The operator who has to assemble the flooring is not forced to fix wooden boards one after the other, but it is sufficient for him to fix the plates 14 to the respective feet since the boards 26 are already fixed to the grid 16.

Also in the case of breakages in portions of the flooring, it is sufficient to lift the one or more plates 14 of the sector in question without having to first lift the wooden boards.

According to a variant of the invention, a treading plate may comprise two or more grids on which wooden boards are fixed which cover, as a whole, the entire surface of the two or more grids.

For example, the wooden boards may have a length greater than a single grid and cover in length the two or more grids which are covered in width by the set of the boards.

In this way, the realization of the flooring may take place even more quickly by using larger plates.

Other variants and embodiments are still possible which are to be considered as included in the scope of protection defined by the claims.

For example, the conformation of the plates may be different from the square shape and may be rectangular or may have another shape provided that an optimum modularity is ensured.

In addition, the number of wooden boards arranged on the grid can be different from six; despite the different number, but with different width, the wooden boards can still cover the entire surface of the grid.

The invention claimed is:

1. Supporting system comprising a floor with boards, said floor being elevated with respect to the reference ground, said supporting system comprising a treading plate and at least three supporting feet fixed to the plate in order to support said plate with respect to the reference ground, wherein the plate comprises at least one grid of quadrangular conformation having pre-formed holes formed therein for passage of nails, at least two boards being fixed by nails to the at least one grid, said boards having a length equal to the length of the at least one grid and having an overall width equal to the width of the at least one grid so as to cover the entire surface of said at least one grid;

wherein at least one recessed seat is formed in the at least one grid, a strip of a rigid material being fitted within said at least one recessed seat;

wherein additional holes are formed in the at least one grid, said additional holes defining additional seats for the fixing of said feet;

wherein the at least one grid comprises corners which are sunken; and wherein an additional seat is formed at each corner of the at least one grid for a stable connection with one of said feet.

2. Supporting system according to claim 1, wherein the at least one recessed seat is formed along a side of the at least one grid.

3. Supporting system according to claim 1, wherein the at least one recessed seat comprises four recessed seats, said strip being fitted within one of said four recessed seats and additional strips being fitted within the other three of said four recessed seats.

4. Supporting system according to claim 3, wherein each of the four recessed seats is formed along each side of the at least one grid.

5. Supporting system according to claim 2, wherein the at least one recessed seat comprises four recessed seats, said strip being fitted within one of said four recessed seats and additional strips being fitted within the other three of said four recessed seats.

6. Supporting system according to claim 5, wherein each of the four recessed seats is formed along each side of the at least one grid.

7. Supporting system according to claim 6, wherein the boards are fixed to the at least one grid by means of nails.

8. Supporting system according to claim 1, wherein the at least one grid (16) comprises corners which are sunken.

* * * * *